US007460072B1

(12) United States Patent
Goldberger

(10) Patent No.: US 7,460,072 B1
(45) Date of Patent: Dec. 2, 2008

(54) MINIATURE PATCH ANTENNA WITH INCREASED GAIN

(75) Inventor: Haim Goldberger, Modi'in (IL)

(73) Assignee: Origin GPS Ltd., Jerusalem (IL)

( * ) Notice: Subject to any disclaimer, the term of this patent is extended or adjusted under 35 U.S.C. 154(b) by 18 days.

(21) Appl. No.: 11/773,448

(22) Filed: Jul. 5, 2007

(51) Int. Cl.
*H01Q 1/38* (2006.01)

(52) U.S. Cl. ..... 343/700 MS; 343/829

(58) Field of Classification Search ..... 343/700 MS, 343/829, 846, 848
See application file for complete search history.

(56) References Cited

U.S. PATENT DOCUMENTS

| | | | | |
|---|---|---|---|---|
| 4,903,033 | A | 2/1990 | Tsao et al. | |
| 4,914,445 | A * | 4/1990 | Shoemaker | 343/700 MS |
| 5,043,738 | A | 8/1991 | Shapiro et al. | |
| 5,266,961 | A * | 11/1993 | Milroy | 343/772 |
| 5,450,090 | A * | 9/1995 | Gels et al. | 343/700 MS |
| 5,627,550 | A | 5/1997 | Sanad | |
| 5,818,391 | A | 10/1998 | Lee | |
| 5,844,523 | A * | 12/1998 | Brennan et al. | 343/700 MS |
| 6,018,320 | A | 1/2000 | Jidhage et al. | |
| 6,121,930 | A * | 9/2000 | Grangeat et al. | 343/700 MS |
| 6,567,048 | B2 | 5/2003 | McKinzie, III et al. | |
| 6,822,616 | B2 | 11/2004 | Durham et al. | |
| 6,937,192 | B2 | 8/2005 | Mendolia et al. | |
| 6,943,731 | B2 * | 9/2005 | Killen et al. | 343/700 MS |
| 7,071,877 | B2 | 7/2006 | Okado | |
| 7,099,686 | B2 | 8/2006 | Ro et al. | |
| 7,123,208 | B2 | 10/2006 | Baliarda et al. | |
| 2004/0080455 | A1 | 4/2004 | Lee | |
| 2006/0103576 | A1 | 5/2006 | Mahmoud et al. | |
| 2006/0250308 | A1 | 11/2006 | Pinel et al. | |

* cited by examiner

*Primary Examiner*—Tho G Phan
(74) *Attorney, Agent, or Firm*—Soroker - Agmon, Advocates & Patent Attorneys

(57) ABSTRACT

The present invention, relates to the preparation of a patch antenna with a specific effective dielectric constant; and a reduced dissipation factor. In an exemplary embodiment of the invention, size requirements and the desired resonant signal frequency dictate the permittivity value of the dielectric material to be used between the patch plate and the ground plate. Instead of using a dielectric material with the calculated permittivity value and its given dissipation factors a two layer dielectric of the same size with an effective dielectric constant that is equal to the desired dielectric constant, is used to replace the dielectric material and reduce the dissipation factor.

18 Claims, 5 Drawing Sheets

(SECTION A-A)

MINIATURE PATCH ANTENNA WITH INCREASED GAIN

FIELD OF THE INVENTION

The present invention relates generally to the manufacture of miniature patch antennas and more specifically to increasing the gain provided by a specific size patch antenna.

BACKGROUND OF THE INVENTION

Patch antennas are very popular in telecommunication devices since they are rugged and are easily incorporated into the device. A patch antenna consists of a metal patch plate that is suspended over a metal ground plane. Generally the metal patch plate is essentially rectangular with an even or almost even width and length. The ground plate is generally the same size or slightly larger to provide optimal signal reception.

Typically, a patch antenna with a vacuum between the plates has a resonant frequency for a signal when the patch plate has a length of about half the size of the wavelength of the signal, for example for a GPS signal with a frequency of approximately 1.5-1.6 GHz, half a wavelength would be about 95 mm. When manufacturing miniature devices a smaller patch antenna is desired. The use of a dielectric material between the plates reduces the required plate size. The required length for a patch antenna with a dielectric material between the plates can be calculated by the equation: $L=C/2f(\in)^{1/2}$. Wherein L=the patch size length, C=the speed of light, f=the frequency of the signal under consideration, and $\in$ is the dielectric constant. In the example given above the use of a dielectric with a dielectric constant of 17 would provide a length value of approximately 23 mm, which can be incorporated more readily into a miniature device.

The distance between the plates of the antenna also influences the effective bandwidth of the antenna, generally the smaller the distance between the plates the less the energy is radiated and the more the energy is stored in the patch antenna as capacitance and inductance. On the other hand too big a distance also reduces the effectiveness of the antenna. Thus there is generally an optimal distance for positioning the plates; however the height may be dictated by size considerations of the device in which the antenna is to be used. The effectiveness of the antenna is generally measured by the Q factor (quality factor). A low Q factor signifies a high rate of energy loss and a low gain, whereas a high Q factor signifies a low rate of energy loss and a high gain. Some people refer to the dissipation factor (DF), which is proportional to the inverse of the Q factor, to represent the effectiveness of the antenna. As an example the Web site www.emtalk.com/mpcalc.php provides a calculator for calculating the required size (length, width) of a patch antenna based on a given resonant frequency, a dielectric constant and dielectric height.

The dielectric material used between the plates also affects the gain provided by a specific antenna configuration. Generally, the higher the dielectric constant of the dielectric used between the plates the greater the energy loss and the lower the gain, thus by introducing a dielectric material with a high dielectric constant to reduce the size required for the antenna we also reduce the signal gain provided by the antenna. In spite of this general rule some dielectric materials have a lower dissipation factor than others even if they have approximately the same dielectric constant.

By defining an antenna size and specific resonant frequency we define the required dielectric constant. Generally, certain materials with specific dielectric constants are available in the market; however dielectric manufacturers can tailor to the needs of clients by preparing a dielectric material with a specific dielectric constant by mixing dielectric materials.

SUMMARY OF THE INVENTION

An aspect of an embodiment of the invention, relates to the preparation of a patch antenna with a specific effective dielectric constant; and a reduced dissipation factor. In an exemplary embodiment of the invention, size requirements and the desired resonant signal frequency dictate the permittivity value of the dielectric material to be used between the patch plate and the ground plate. Instead of using a dielectric material with the calculated permittivity value and its given dissipation factor, a two layer dielectric of the same size with an effective dielectric constant that is equal to the desired dielectric constant, is used to replace the dielectric material and reduce the dissipation factor.

In an exemplary embodiment of the invention, one of the layers is provided with a higher dielectric constant and one layer is provided with a lower dielectric constant than the material being replaced. The relative height of each layer is selected so that the effective dielectric constant is equal to the desired dielectric constant. In an exemplary embodiment of the invention, the dielectric materials of the two layers are selected from materials with low dissipation factors, optionally both lower than the dissipation factor of the materials available with the dielectric constant that they are replacing, so that the effective dissipation factor will also be lower than the dissipation factor of the material being replaced. In some embodiments of the invention, the dissipation factor of one of the layers is lower than the dissipation factor of the dielectric material being replaced and the dissipation factor of the second layer is the same or greater than the dissipation factor of the dielectric material being replaced, as long as the effective dissipation factor is lower than that of the dielectric material being replaced.

In some embodiments of the invention, the above method is used to provide a dielectric material with a selected dielectric constant by providing a thicker layer of one of the dielectric materials relative to the other. If a material with the approximate dielectric constant exists the above method can provide a dielectric material with a reduced dissipation factor by selecting dielectric materials with lower dissipation factors.

In an exemplary embodiment of the invention, the dielectric material with the higher dielectric constant is positioned adjacent to the ground plate of the antenna and the dielectric material with the lower dielectric constant is positioned adjacent to the patch plate to provide optimal performance. Alternatively, the dielectric materials may be positioned in any order.

In some embodiments of the invention, more than two dielectric materials are used between the plates to allow more control in achieving the desired values.

There is thus provided according to an exemplary embodiment of the invention, a method of creating a dielectric material with a specific dielectric constant and a reduced dissipation factor, comprising:

Selecting two or more dielectric materials to be used instead of a single dielectric material with the specific dielectric constant, wherein at least one of the dielectric materials has a dielectric constant lower than the specific dielectric constant and at least one of the dielectric materials has a dielectric constant greater than the specific dielectric constant;

Calculating a height for each of the dielectric materials so that if placed one on top of another instead of using the single dielectric material the effective dielectric constant is equal to the dielectric constant of the single dielectric material;

Calculating the effective dissipation factor resulting from the selected dielectric materials and calculated heights;

Wherein at least one of the selected dielectric materials has a dissipation factor lower than the dissipation factor of the single dielectric material; and the other selected dielectric materials have a dissipation factor such that the calculated effective dissipation factor is less than the dissipation factor of the single dielectric constant. In an exemplary embodiment of the invention, all of the selected two or more dielectric materials have a dissipation factor that is less than the dissipation factor of the single dielectric material.

Optionally, two dielectric materials are used to replace the single dielectric material. In an exemplary embodiment of the invention, the method comprises coating a conductive layer on the top side of the top most selected dielectric material or placing a sheet of conducting material on the top side of the top most selected dielectric material to serve as a patch plate for a patch antenna. Optionally, the method further comprises coating a conductive layer on the bottom side of the bottom most selected dielectric material or placing a sheet of conducting material on the bottom side of the bottom most selected dielectric material to serve as a ground plate for a patch antenna. In an exemplary embodiment of the invention, the patch plate is the same size as the ground plate. Alternatively, the patch plate is smaller than the ground plate. Optionally, the patch plate is rectangular with truncated corners. In an exemplary embodiment of the invention, the bottom most dielectric material has the highest dielectric constant and the top most dielectric material has the lowest dielectric constant. Optionally, the method further comprises adhesively connecting the selected dielectric materials together. In an exemplary embodiment of the invention, the method further comprises connecting the selected dielectric materials together using heat. Optionally, the method further comprises punching a hole through the selected dielectric materials to pass a feed line from a patch plate past a ground plate. In an exemplary embodiment of the invention, the method further comprises enclosing the antenna in an encasement. Optionally, the height of the resulting antenna is less than 1 mm.

There is further provided according to an exemplary embodiment of the invention, a patch antenna with a reduced dissipation factor and a specific dielectric constant, comprising:

A conducting patch layer;

A conducting ground layer;

Two or more dielectric layers between the conducting layers; wherein each dielectric layer has a different dielectric constant and a pre-selected height; such that the two or more dielectric layers effectively function as a single dielectric material with the specific dielectric constant; and Wherein the two or more dielectric layers have dissipation factors which together effectively function as a single dielectric material having an effective dissipation factor that is less than the dissipation factor of a given dielectric material with the specific dielectric constant. Optionally, at least one of the dissipation factors is less than the dissipation factor of the given dielectric material. In an exemplary embodiment of the invention, all of the dissipation factors are less than the dissipation factor of the given dielectric material. Optionally, the dielectric material next to the ground layer has a higher dielectric constant than the dielectric constant of the layer next to the patch layer.

BRIEF DESCRIPTION OF THE DRAWINGS

The present invention will be understood and better appreciated from the following detailed description taken in conjunction with the drawings. Identical structures, elements or parts, which appear in more than one figure, are generally labeled with the same or similar number in all the figures in which they appear, wherein.

DETAILED DESCRIPTION

Figure 1A:
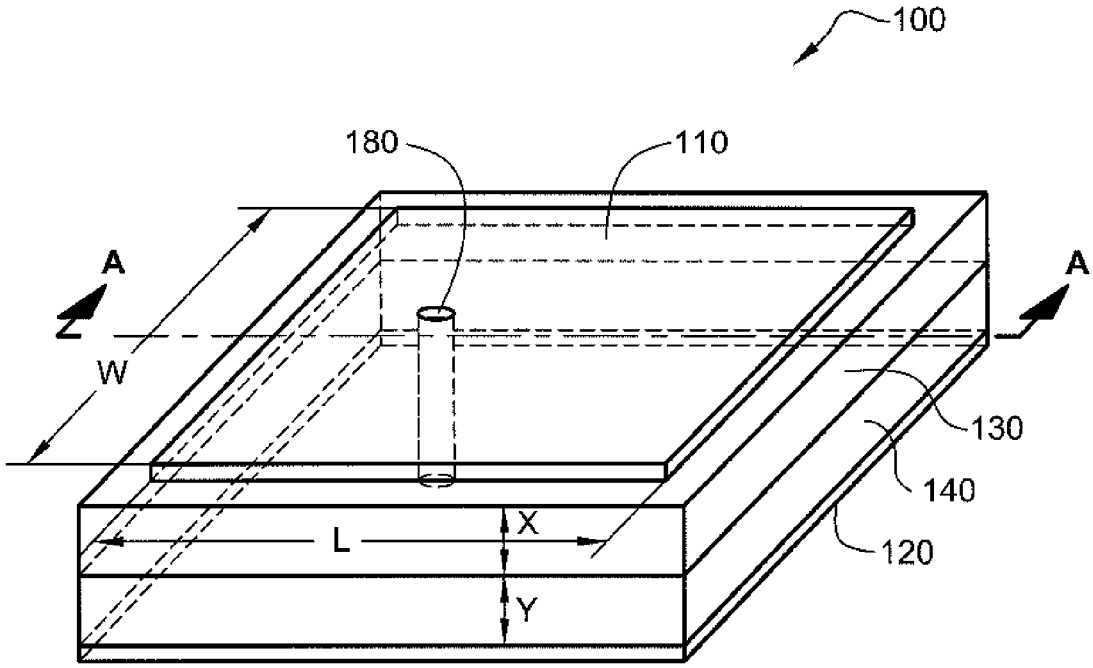
FIG. 1A is a schematic illustration of a perspective view of patch antenna with 2 dielectric materials between the plates, according to an exemplary embodiment of the invention.

FIG. 1A is a schematic illustration of a perspective view of a patch antenna 100 with 2 layers of dielectric materials (130, 140) between the plates, according to an exemplary embodiment of the invention. In an exemplary embodiment of the invention, patch antenna 100 has a width W and a length L, wherein W and L may or may not be equal. As explained above the values of W and L are among the factors that determine the value of the dielectric constant needed between the plates of patch antenna 100. Patch antenna 100 includes a conducting patch plate 110 that is positioned in parallel to a ground plate 120. One of the dielectric material layers 140 serves in the antenna as a lower layer that is tangent to ground plate 120 and has a thickness Y. The second dielectric material layer 130 serves in the antenna as an upper layer that is tangent to patch plate 10 and has a thickness X. In an exemplary embodiment of the invention, the 2 dielectric layers (130, 140) affect the performance of antenna 100 essentially as if a single dielectric material were placed between the plates (110, 120) with an effective dielectric constant that can be calculated by the following equation:

$$E_{eff}=(t1+t2)/(t1/E1+t2/E2);$$

Wherein t1 is the thickness X of the upper layer and t2 is the thickness Y of the lower layer. E1 is the dielectric constant of the upper layer dielectric material 130 and E2 is the dielectric constant of the lower layer dielectric material 140. Optionally, the provided effective dielectric constant may differ slightly from the original dielectric constant, for example 17.1 or 16.9 instead of 17 without changing the width (W) and length (L) of the antenna, as long as the resonant wave frequency of the antenna does not change significantly and effect the gain of the antenna. Alternatively, the width (W) and length (L) of the antenna may be altered to accommodate the change in dielectric constant.

In an exemplary embodiment of the invention, each layer has a dissipation factor (DF) that affects the resulting gain of the antenna. The dissipation factor is also referred to as the tangent delta value of the material. The effective dissipation factor $DF_{eff}$ can be calculated by the following equation:

$$DF_{eff}=(t1+t2)/(t1/DF1+t2/DF2);$$

Wherein t1 is the thickness X of the upper layer and t2 is the thickness Y of the lower layer. DF1 is the dissipation factor of the upper layer dielectric material 130 and DF2 is the dissipation factor of the lower layer dielectric material 140.

Optionally, to improve the resulting gain of a patch antenna with a given dielectric material, a designer selects a first dielectric material with a higher dielectric constant and a low dissipation factor (e.g. lower than the dissipation factor of the material being replaced), and a second dielectric material with a lower dielectric constant and a low dissipation factor. In an exemplar embodiment of the invention, the dielectric material with the higher dielectric constant is placed next to the ground plate and the dielectric material with the lower dielectric constant is placed next to the patch plate, for example to maximize the performance of the antenna. Alternatively, the dielectric layers may be placed in the opposite order, for example to simplify manufacture of the antenna. In an exemplary embodiment of the invention, the designer selects a thickness for each layer to provide an effective dielectric constant that is approximately equal to the dielectric constant of the material being replaced. Similarly, the dissipation factor can be calculated from the given details according to the equation given above.

In an exemplary embodiment of the invention, the dissipation factor for both replacement materials is lower than the dissipation factor for the replaced material therefore the effective dissipation factor will be lower than the original dissipation factor. In some embodiments of the invention, the dissipation factor for one of the materials may be greater than the dissipation factor of the original material as long as the calculated effective dissipation factor is lower than the original dissipation factor.

In some embodiments of the invention, more than 2 dielectric layers may be used to replace a single dielectric material according to the principles described above, for example for 3 dielectric materials the effective dielectric constant and effective dissipation factor can be calculated by:

$$E_{eff}=(t1+t2+t3)(t1/E1+t2/E2+t3/E3);\text{ and}$$

$$DF_{eff}=(t1+t2+t3)/(t/DF1+t2/DF2+t3/DF3).$$

Optionally, the use of more than 2 dielectric materials provides greater flexibility in achieving specific values for the effective dielectric constant and the effective dissipation factor. In some embodiments of the invention, the above method can be applied to antennas with lengths varying from 1 mm to 1000 mm or even larger. Optionally the height of the antenna may vary from 1% to 50% of the length, for example the height of the antenna may be less than 1 mm, less than 10 mm or less than 100 mm.

In an exemplary case a square patch antenna for GPS reception is required with a length and width of about 23.5 mm and thickness of 0.9 mm. According to the above description a dielectric material with a dielectric constant of about 17 is needed to match the required dimensions. Optionally, co-fire ceramic tape 41060 manufactured by ESL Electro-Science from King of Prussia, Pa., USA can be used as the dielectric material for manufacturing the antenna. Co-fire ceramic tape 41060 has a dielectric constant of about 16-17 and a dissipation factor of about 0.2%. According to an exemplary embodiment of the invention, a lower layer of 0.515 mm is provided as dielectric tape CT765 manufactured for example by Herause from Germany with a dielectric constant of about 68 and dissipation factor of about 0.173%. An upper layer of 0.385 mm is provided as Alumina 96% manufactured for example by Coors Tech from Colorado USA with a dielectric constant of about 9 and a dissipation factor of about 0.02%. The resulting antenna will have an effective dielectric constant of about 17 and an effective dissipation factor of about 0.04%. Optionally, Alumina 99.5% with a dissipation factor of about 0.01% can be used to provide an effective dissipation factor of about 0.02%. The suggested replacement dielectric created by using two selected dielectrics is able to replace the single dielectric and improve the gain of the resulting antenna by about 1 dB or more, as described below.

Figure 1B:
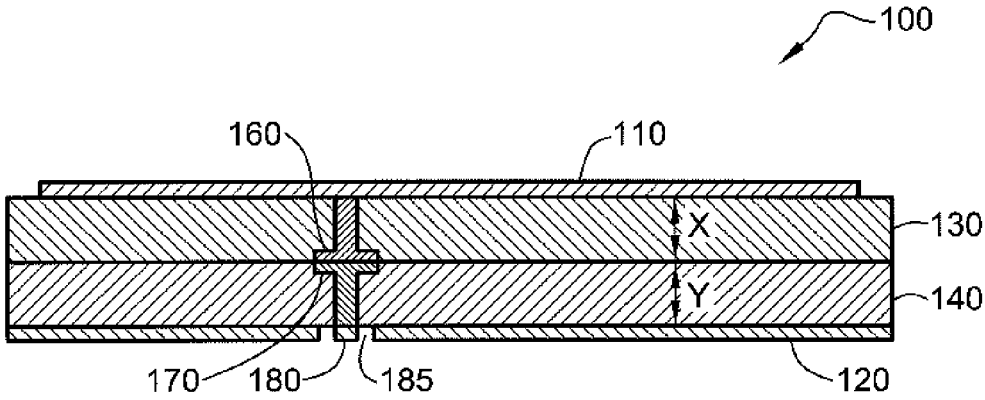
FIG. 1B is a schematic illustration of a cross sectional view of a patch antenna with 2 dielectric materials between the plates, according to an exemplary embodiment of the invention.

FIG. 1B is a schematic illustration of a cross sectional view (AA) of patch antenna 100 with 2 dielectric materials between the plates, according to an exemplary embodiment of the invention. In an exemplary embodiment of the invention, each layer of patch antenna 100 is provided as an independent material and the layers are adhesively attached together to form patch antenna 100. Alternatively or additionally, the layers may be held together by a heating process or by physical elements such as connectors, pins, nails, screws, or dowels. In some embodiments of the invention, the heating process requires a mediator layer that serves as the adhesive to connect between the two dielectric materials. Exemplary mediator layers may be Epoxy, glass sealing paste, green tape or ceramic paste. In some embodiments of the invention, the mediator layer may be negligible relative to the dielectric materials, for example less than 1% of the thickness of the antenna, and have little effect on the dielectric constant and dissipation factor. Alternatively, the mediator layer may be thicker, for example 10% of the thickness of the antenna or larger. Optionally, the mediator level will be considered as a third dielectric material, and it is taken into account in planning the antenna as described above.

In some embodiments of the invention, the antenna is enclosed in an encasement, for example a plastic or ceramic encasement to protect it and/or keep it together. Optionally, the encasement may be a partial encasement or a complete encasement of patch antenna 100.

In an exemplar embodiment of the invention, a feed line 180 connects between patch plate 110 and a circuit that is fed by the signal that is received by antenna 100. Optionally, feed line 180 has a diameter that is small relative to the size of patch antenna 100 (*W, L*), for example between 0.1 mm-0.2 mm. In some embodiments of the invention, feed line 180 passes through the dielectric material to minimize the distance it needs to travel to the circuit, for example as shown in FIG. 1. Alternatively, feed line 180 may circumvent the dielectric material so as not to interfere with the form of the reception fields. In some embodiments of the invention, feed line 180 is provided as a conductor that is attached to patch plate 110 and isolated from ground plate 120 as shown in FIG. 1B. Alternatively, feed line 130 may be formed by forming a hole through patch antenna 100 and filling it with a conducting material (e.g. solder or silver). Optionally, ground plate 120 has a gap 185 between ground plate 120 and feed line 180 to isolate feed line 180 from ground plate 120.

In an exemplary embodiment of the invention, the antenna is formed from two sheets of dielectric material that serve as dielectric layers 130 and 140. A metal layer is printed on one side of the dielectric layers (130, 140) to serve as patch plate 110 and ground plate 120. Optionally, line feed 180 is formed by using a via punch process and filling the via hole during the metallization process. In some embodiments of the invention the sheets are aligned and heated to form a sheet of antennas, which can be cut to single antennas in a dicing process. In some embodiments of the invention, the bottom part of the hole for line feed 180 on both sheets is widened, so that during metallization each dielectric layer has a wider contact point (160, 170) to enhance contact between the line feed from both dielectric layers (130, 140). In some embodiments of the invention, the sheets are connected using an adhesive instead of or in addition to being attached by a heating process.

Figure 2A:
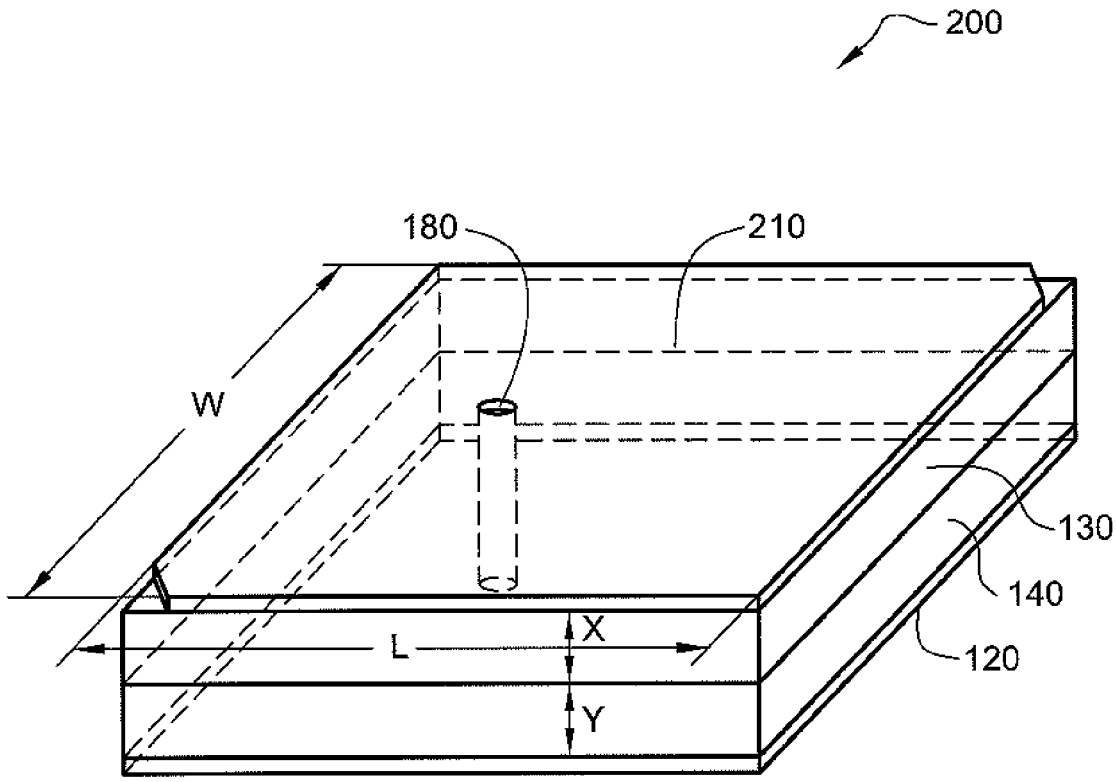
FIG. 2A is a schematic illustration of a perspective view of an alternative patch antenna with 2 dielectric materials between the plates, according to an exemplary embodiment of the invention.
Figure 2B:
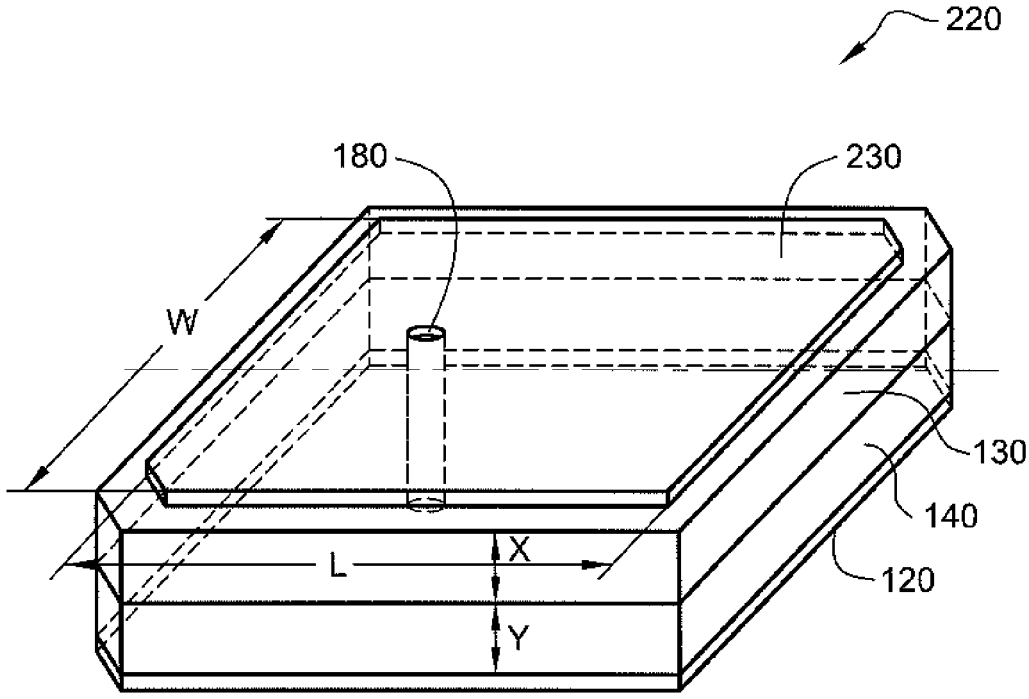
FIG. 2B is a schematic illustration of a perspective view of another alternative patch antenna with 2 dielectric materials between the plates, according to an exemplary embodiment of the invention.

FIGS. 2A and 2B are schematic illustrations of perspective views of alternative patch antennas (200 and 220) with 2 dielectric materials between the plates, according to an exemplary embodiment of the invention. Optionally, patch antennas 200 and 220 are similar to patch antenna 100 except for the shape and size of the respective patch plates 210, and 230 and/or the size and shape of the dielectric material between the patch plate and the ground plate. Optionally, the differences in size and shape may affect the reception of the antenna. In some embodiments of the invention, waves with different polarization are affected differently by different shaped antennas.

In FIG. 1A, patch plate 110 and ground plate 120 are shown to be the same shape and same size, for example both are squares (W=L) with the same size. Alternatively, other shapes can be used for either one, for example a rectangle, an ellipse or a circle. Optionally, some of the corners may be truncated, for example as shown in FIGS. 2A and 2B. In some embodiments of the invention, patch plate 110 is smaller than ground plate 120, for example 5% smaller or 10% smaller, to improve performance of the resulting antenna.

In FIG. 2A patch plate 210 is the same size as ground plate 120, but with truncated corners. In FIG. 2B patch plate 230 is smaller than ground plate 120 and its corners are truncated. Additionally, in FIG. 2B the corners of the dielectric materials (130, 140) are also truncated to improve performance of the antenna.

Figure 3:
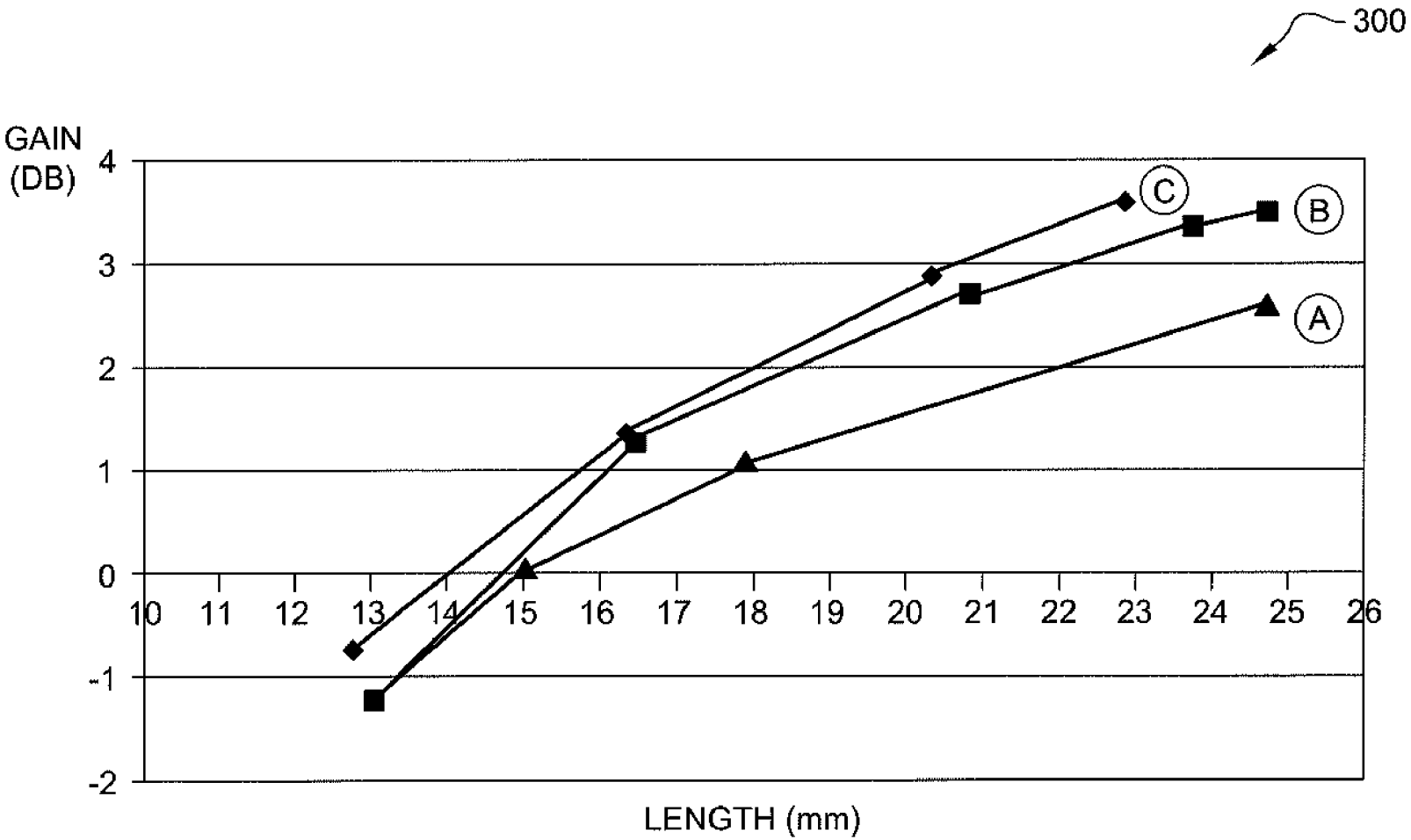
FIG. 3 is a graph illustrating the gain provided by various patch antennas as a function of their size, according to an exemplary embodiment of the invention.
Figure 4:
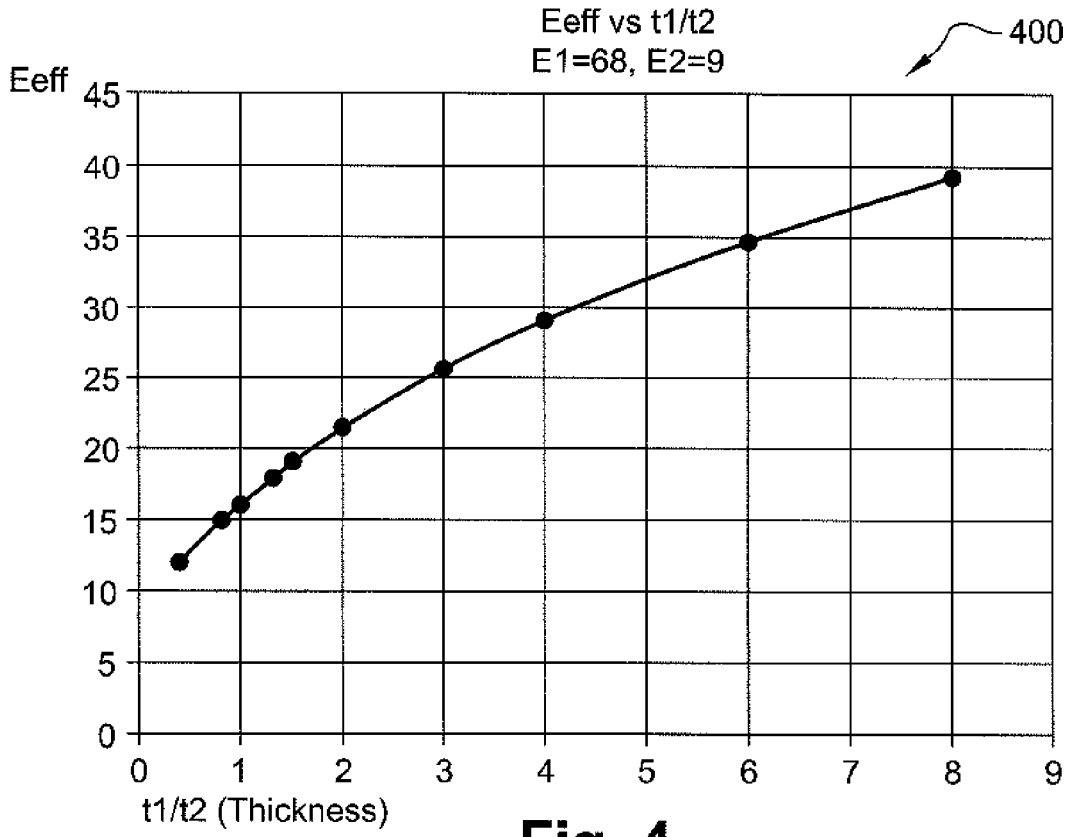
FIG. 4 is a graph illustrating the effective dielectric constant of a combination dielectric material as a function of the thickness of its components, according to an exemplary embodiment of the invention.

FIG. 3 is a graph 300 illustrating the gain provided by various patch antennas as a function of their size, according to an exemplary embodiment of the invention. Line A of graph 300 shows a patch antenna with the geometry of patch antenna 220, however with a single dielectric material between the plates of the antenna. Line B of graph 300 shows patch antenna 220 with 2 dielectric materials between the plates of the antenna and a lower dissipation factor than the antenna of graph A. Graph 300 shows that antenna 220 provides an increase in gain of approximately 1 dB when built with 2 dielectric materials with a lower dissipation factor in contrast to an antenna using a single dielectric material with a higher dissipation factor. Line C of graph 300 shows antenna 200, which is similar to antenna 100 but differs from it by the geometry of the patch plate, as described above. Line C shows an increase in gain relative to line B due to the change in the size and shape of the patch plate FIG. 4 is a graph 400 illustrating the effective dielectric constant of a combination dielectric material as a function of the thickness of its components, according to an exemplary embodiment of the invention. As shown in FIG. 4 when the thickness of the first dielectric material (t1) with the higher dielectric constant is much larger than the thickness of the second dielectric material (t2) (t1>>t2) the effective dielectric constant aspires toward the dielectric constant of the first dielectric material. When the thickness of the first dielectric material (t1) with the higher dielectric constant is much smaller than the thickness of the second dielectric material (t2) (t1<t2) the effective dielectric constant aspires toward the dielectric constant of the first dielectric material. When the thickness of both dielectrics is almost equal (t1==t2) an intermediate value is achieved.

Figure 5:
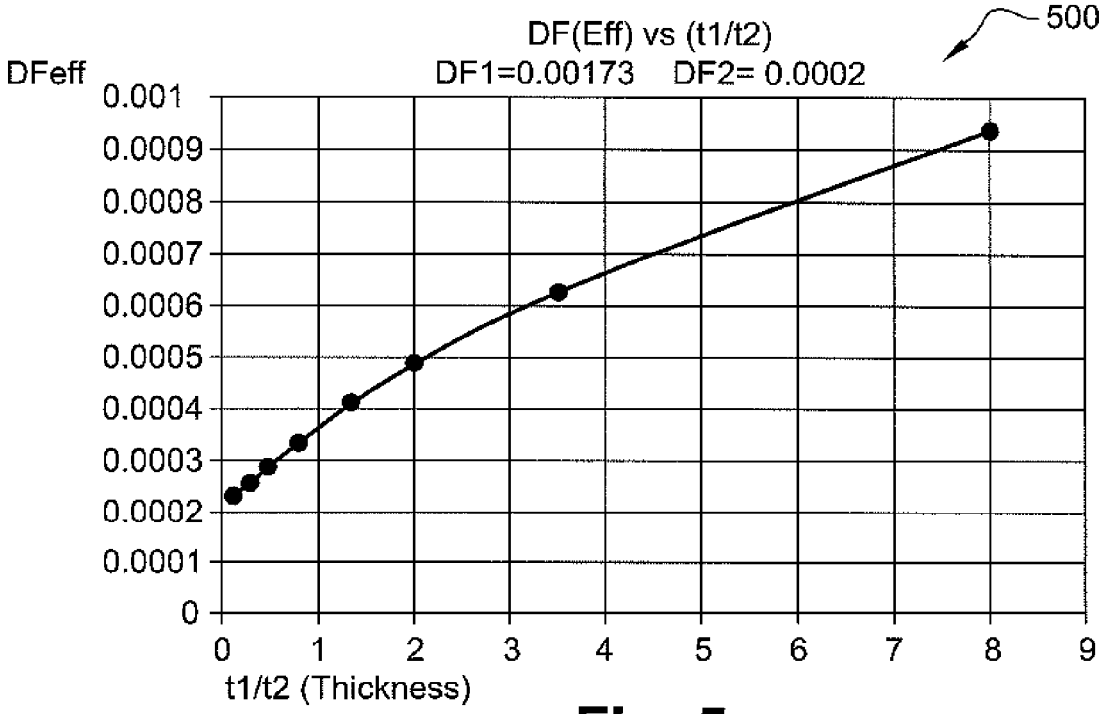
FIG. 5 is a graph illustrating the effective dissipation factor of a combination dielectric material as a function of the thickness of its components, according to an exemplary embodiment of the invention.

FIG. 5 is a graph 500 illustrating the effective dissipation factor of a combination dielectric material as a function of the thickness of its components, according to an exemplary embodiment of the invention. As shown in FIG. 5 when the thickness of the first dielectric material (t1) is greater the effective dissipation factor $DF_{eff}$ aspires toward DF1 and when the thickness of the second dielectric material (t2) is greater the effective dissipation factor $DF_{eff}$ aspires toward DF2. Thus by selecting the thickness of the two dielectric materials we can control the effective dielectric constant and effective dissipation factor within the bounds set by the selected dielectric materials.

In an exemplary embodiment of the invention, the patch antenna may be manufactured to be connected to a circuit by various methods, for example by surface mount technology, pin connection, or by a coaxial line.

It should be appreciated that the above described methods and apparatus may be varied in many ways, including omitting or adding steps, changing the order of steps and the type of devices used. It should be appreciated that different features may be combined in different ways. In particular, not all the features shown above in a particular embodiment are necessary in every embodiment of the invention. Further combinations of the above features are also considered to be within the scope of some embodiments of the invention.

It will be appreciated by persons skilled in the art that the present invention is not limited to what has been particularly shown and described hereinabove. Rather the scope of the present invention is defined only by the claims, which follow.

What is claimed is:

1. A method of creating a dielectric material with a specific dielectric constant and a reduced dissipation factor, comprising:

selecting two or more dielectric materials to be used instead of a single dielectric material with the specific dielectric constant, wherein at least one of the dielectric materials has a dielectric constant lower than the specific dielectric constant and at least one of the dielectric materials has a dielectric constant greater than the specific dielectric constant;

calculating a height for each of the dielectric materials so that if placed one on top of another instead of using the single dielectric material the effective dielectric constant is equal to the dielectric constant of the single dielectric material;

calculating the effective dissipation factor resulting from the selected dielectric materials and calculated heights;

wherein at least one of the selected dielectric materials has a dissipation factor lower than the dissipation factor of the single dielectric material; and the other selected dielectric materials have a dissipation factor such that the calculated effective dissipation factor is less than the dissipation factor of the single dielectric constant.

2. A method according to claim 1, wherein all of the selected two or more dielectric materials have a dissipation factor that is less than the dissipation factor of the single dielectric material.

3. A method according to claim 1, wherein two dielectric materials are used to replace the single dielectric material.

4. A method according to claim 1, further comprising coating a conductive layer on the top side of the top most selected dielectric material or placing a sheet of conducting material on the top side of the top most selected dielectric material to serve as a patch plate for a patch antenna.

5. A method according to claim 4, further comprising coating a conductive layer on the bottom side of the bottom most selected dielectric material or placing a sheet of conducting material on the bottom side of the bottom most selected dielectric material to serve as a ground plate for a patch antenna.

6. A method according to claim 5, wherein said patch plate is the same size as said ground plate.

7. A method according to claim 5, wherein said patch plate is smaller than said ground plate.

8. A method according to claim 5, wherein said patch plate is rectangular with truncated corners.

9. A method according to claim 5, wherein the bottom most dielectric material has the highest dielectric constant and the top most dielectric material has the lowest dielectric constant.

10. A method according to claim 1, further comprising adhesively connecting the selected dielectric materials together.

11. A method according to claim 1, further comprising connecting the selected dielectric materials together using heat.

12. A method according to claim 1, further comprising punching a hole through the selected dielectric materials to pass a feed line from a patch plate past a ground plate.

13. A method according to claim 1, further comprising enclosing the antenna in an encasement.

14. A method according to claim 1, wherein the height of the resulting antenna is less than 1 mm.

15. A patch antenna with a reduced dissipation factor and a specific dielectric constant, comprising:

a conducting patch layer;

a conducting ground layer;

two or more dielectric layers between the conducting layers; wherein each dielectric layer has a different dielectric constant and a pre-selected height; such that the two or more dielectric layers effectively function as a single dielectric material with said specific dielectric constant; and wherein said two or more dielectric layers have dissipation factors which together effectively function as a single dielectric material having an effective dissipation factor that is less than the dissipation factor of a given dielectric material with said specific dielectric constant.

16. A patch antenna according to claim 15, wherein at least one of the dissipation factors is less than the dissipation factor of said given dielectric material.

17. A patch antenna according to claim 15, wherein all of the dissipation factors are less than the dissipation factor of said given dielectric material.

18. A patch antenna according to claim 15, wherein the dielectric material next to the ground layer has a higher dielectric constant than the dielectric constant of the layer next to the patch layer.

* * * * *